US005458515A

United States Patent [19]

Busetti

[11] Patent Number: 5,458,515

[45] Date of Patent: Oct. 17, 1995

[54] DEVICE FOR WINDING UP A LINE AROUND THE CIRCUMFERENCE OF A LIFE-BUOY

[76] Inventor: Raffaello Busetti, via Farnesina, 100-00184 Roma, Italy

[21] Appl. No.: 232,051

[22] PCT Filed: Sep. 3, 1993

[86] PCT No.: PCT/IT93/00091

§ 371 Date: Apr. 26, 1994

§ 102(e) Date: Apr. 26, 1994

[87] PCT Pub. No.: WO94/05542

PCT Pub. Date: Mar. 17, 1994

[30] Foreign Application Priority Data

Sep. 4, 1992 [IT] Italy ..... RM92A0639

[51] Int. Cl.[6] ..... B63C 9/08

[52] U.S. Cl. ..... 441/81

[58] Field of Search ..... 441/81–84; 114/190

[56] References Cited

U.S. PATENT DOCUMENTS 2,342,868 2/1944 King ..... 441/81

4,033,276 7/1977 Bahr ..... 441/81 X 4,416,640 11/1983 Eickenhorst ..... 441/81

FOREIGN PATENT DOCUMENTS 3010529 2/1980 Germany .

0982601 2/1965 United Kingdom ..... 441/81

*Primary Examiner*—Sherman Basinger

*Attorney, Agent, or Firm*—Beveridge, DeGrandi, Weilacher & Young

[57] ABSTRACT

A device for winding up a line around a circumference of a life-buoy includes a life-buoy body with an annular groove defined therein. This annular groove receives a line in a plurality of overlaying windings. Supports are provided around the life-buoy body, and the annular groove is positioned so that it avoids interference with the supports. A line connects adjacent supports so that a line runs around the perimeter of the life-buoy. In order to compensate for the annular groove, the life-buoy body has an increased volume to balance a loss of hydrostatic push due to the volume of the annular groove. The annular groove is continuous and located in a decentralized position around an outer circumference of the life-buoy body.

3 Claims, 1 Drawing Sheet

DEVICE FOR WINDING UP A LINE AROUND THE CIRCUMFERENCE OF A LIFE-BUOY

BACKGROUND OF THE INVENTION

The present invention concerns a device for winding up a line around the circumference of life-buoys.

It is well known that the life-buoys provided along the broadsides of ships or other floating means must have, according to international rules, a line of a predetemined length, one end thereof being fixed to the life-buoy and the other one to be linked to the ship, so as to allow the life-buoy and the eventual shipwrecked person to whom said life-buoy has been thrown to be retrieved.

Usually, the line is collected in a hank which sometimes is difficult to unravel, as it might also be hardened by an eventual coat of paint, whereby the original intention of the law is no longer observed.

SUMMARY OF THE INVENTION

It is the aim of the present invention to completely solve above mentioned inconveniences in an easy and functional manner.

The aim set forth is reached, according to the present invention, by means of a device for winding up the line around the circumference of the life-buoys, consisting of means for holding the line obtained in the structure of the life-buoys, or by continuous or section means that may be applied along the circumference in such a way, that the unwinding of the line, in case of need, takes place together with the throwing of the life-buoy.

The main advantage of the device according to the present invention consists in the reduction of the encumbrance of the wound line, as well as the convenience of its functioning.

BRIEF DESCRIPTION OF THE DRAWINGS

The device according to the present invention will be described more in detail hereinbelow, relating to the enclosed drawings in which some preferred embodiments are shown.

DETAILED DESCRIPTION OF THE INVENTION

The enclosed figures show a device for winding up a line S around the circumference of a life-buoy SV, mainly consisting of an annular groove 1 provided in the thickness of the body of life-buoy SV and in a decentralized position, so as to avoid any interference with the supports 3 of the perimetral line sections 4. The annular groove 1 receives the line S in a plurality of overlaying windings, as shown in FIGS. 1 and 2.

Figure 1:
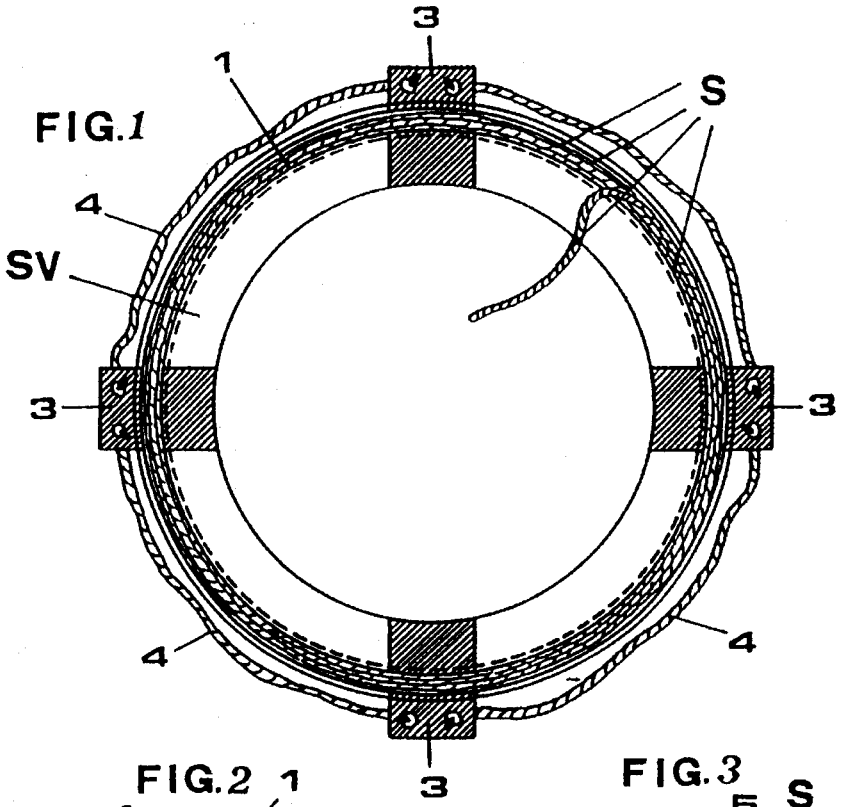
FIG. 1, shows a front and partially transparent view of a device for winding the line around the circumference of a life-buoy.
Figure 2:
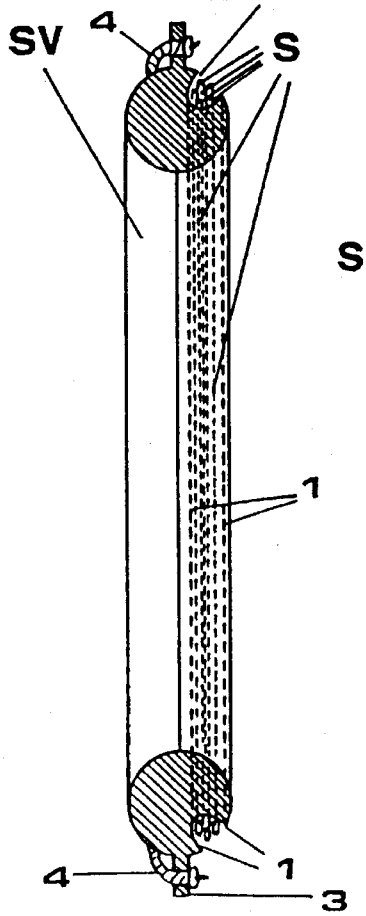
FIG. 2, shows a vertical section of a variant according to FIG. 1.

As illustrated in FIGS. 1 and 2, the life-buoy device SV according to the invention includes a line S wound around the life-buoy device. The life-buoy device SV includes a ring shaped life-buoy body which has an annular groove 1 defined in the body. The life-buoy body defines an inner circumference located at the inside of the ring and an outer circumference located at the outside of the ring. An opening of the annular groove 1 is located on an arc extending between the inner circumference and the outer circumference, and more particularly, the opening is located on the arc between the outer circumference and a point on the arc halfway between the inner circumference and the outer circumference. The annular groove 1 is provided to receive a line S in a plurality of overlaying windings. As further illustrated in FIGS. 1 and 2, a plurality of supports 3 are provided around the life-buoy body. The annular groove 1 is positioned so as to avoid interference with the supports 3. A perimetral line 4 connects adjacent supports 3.

It is obvious that the hollow volume of the annular groove 1 determines a loss of hydrostatic push which, even if very small, will be balanced—according to the present invention—by a small increase of the dimensions of the whole tore.

Figure 3:
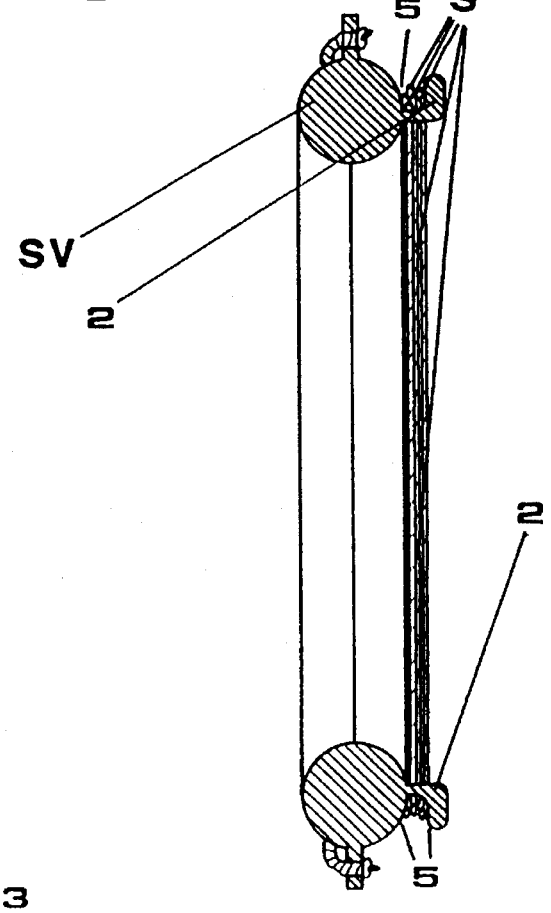
FIG. 3, shows a vertical section of a variant of the device according to the present invention, comprising a means for winding up the line applied externally to the structure of the life-buoy SV.

The variant of above described device requires a new kind of life-buoy construction; but the device according to the present invention may also be applied to already existing life-buoys. For this purpose, a further variant has been shown in FIG. 3 and provides the application, along the median circumference of the life-buoy SV, of a circular supporting guide 2 that forms, together with the structure of the life-buoy SV, the annular housing 5 for receiving a plurality of windings of the line S.

Furthermore, it is not indispensible that the housing 5 consists of a complete circular guide, but it may consist of a plurality of separate, non continuous sections, by means of which the winding of the line S is obtained according to the aim set forth.

I claim:

1. A life-buoy device including a line wound around the life-buoy device, comprising:

a ring shaped life-buoy body including an annular groove defined in said life-buoy body, wherein the ring shaped life-buoy body has an inner circumference and an outer circumference, wherein an opening of the annular groove is located on an arc extending between the inner circumference and the outer circumference, said opening located on said arc between the outer circumference and a point on the arc halfway between the inner circumference and the outer circumference, wherein the annular groove receives a line in a plurality of overlaying windings;

a plurality of supports provided around the life-buoy body, wherein the annular groove is positioned so as to avoid interference with the supports; and a perimetral line connecting adjacent supports.

2. A device according to claim 1, wherein said life-buoy body has an increased volume for balancing a loss of hydrostatic push due to the volume of the annular groove.

3. A device according to claim 1, wherein the annular groove is continuous.

* * * * *